US011174692B2

(12) United States Patent
Clemens et al.

(10) Patent No.: US 11,174,692 B2
(45) Date of Patent: Nov. 16, 2021

(54) CROWN PLUG PULLING TOOL WITH BAILER FEATURE

(71) Applicant: Halliburton Energy Services, Inc., Houston, TX (US)

(72) Inventors: Jack Gammill Clemens, Fairview, TX (US); Mark S. Holly, The Colony, TX (US); Francis Michael Heaney, Tomball, TX (US); David Russ Larimore, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/960,458

(22) PCT Filed: Feb. 23, 2019

(86) PCT No.: PCT/US2019/019322

§ 371 (c)(1),
(2) Date: Jul. 7, 2020

(87) PCT Pub. No.: WO2019/165327

PCT Pub. Date: Aug. 29, 2019

(65) Prior Publication Data

US 2020/0378205 A1 Dec. 3, 2020

Related U.S. Application Data

(60) Provisional application No. 62/634,312, filed on Feb. 23, 2018.

(51) Int. Cl.
*E21B 23/14* (2006.01)
*E21B 33/035* (2006.01)
(Continued)

(52) U.S. Cl.
CPC ..... *E21B 23/14* (2013.01); *E21B 33/035* (2013.01); *E21B 33/043* (2013.01); *E21B 33/064* (2013.01)

(58) Field of Classification Search
CPC ..... E21B 23/14; E21B 33/035; E21B 33/043; E21B 33/064
See application file for complete search history.

(56) References Cited

U.S. PATENT DOCUMENTS 8,869,899 B2 10/2014 Caulfield et al.
10,082,005 B2 * 9/2018 Salomonsen ..... E21B 33/0353
(Continued)

FOREIGN PATENT DOCUMENTS

WO 2010019378 2/2010
WO 2012115891 8/2012

OTHER PUBLICATIONS

ISRWO International Search Report and Written Opinion for PCT/US2019/019322 dated Jun. 11, 2019.

*Primary Examiner* — James G Sayre
(74) *Attorney, Agent, or Firm* — John Wustenberg; C. Tumey Law Group PLLC

(57) ABSTRACT

This disclosure relates generally to pulling tools and, more particularly, to incorporating a bailer feature in pulling tools. A pulling tool may be provided that includes a housing. The pulling tool may further include a tool engagement assembly securing in the housing with a distal end of the tool engagement assembly extending from the housing for engagement with a well tool. The pulling tool may further include a bailer chamber formed in the tool engagement assembly and in fluid communication with an exterior of the pulling tool through an opening in the distal end of the tool engagement assembly. The pulling tool may further include a valve positioned in the opening of the tool engagement assembly.

20 Claims, 7 Drawing Sheets

(51) Int. Cl.
*E21B 33/043* (2006.01)
*E21B 33/064* (2006.01)

(56) References Cited

U.S. PATENT DOCUMENTS

| | | | | |
|---|---|---|---|---|
| 2003/0146000 | A1 | 8/2003 | Dezen et al. | |
| 2007/0289745 | A1 | 12/2007 | Richards | |
| 2009/0236100 | A1* | 9/2009 | Lawson | E21B 33/043 166/339 |
| 2012/0037374 | A1* | 2/2012 | Schuurman | E21B 33/035 166/340 |
| 2012/0227974 | A1* | 9/2012 | Caulfield | E21B 33/0387 166/339 |
| 2014/0124686 | A1* | 5/2014 | Hallundbæk et al. | E21B 33/064 251/1.3 |
| 2017/0016295 | A1 | 1/2017 | Kartha et al. | |
| 2017/0204692 | A1 | 7/2017 | Holly et al. | |

* cited by examiner

CROWN PLUG PULLING TOOL WITH BAILER FEATURE

BACKGROUND

In subsea wells, a plug may be installed in or near the wellhead to seal off the well from the sea. This plug can be referred to as a "crown plug." In some instances, there may be multiple crown plugs installed. For example, a first crown plug may be installed in a profile formed in an internal hanger installed in the wellhead, and a second crown plug may be installed above the first plug. It may be desirable to remove these plugs, for example, to perform workover operations or otherwise gain access to the well. A number of different techniques may be used for crown plug removal including use of a mechanical jarring action using a conventional slickline tool string or with an electro-mechanical pulling tool. Typically, the process of removing a crown plug may require at least two runs downhole. The first run may include a latch confirmation to ensure that the fish neck of the crown plug is clear of debris. If the fish neck is clear of debris, the second run may be to run a separate tool assembly downhole to attempt to remove the crown plug. Often, there is debris in the fish neck, so a bailer may be run downhole to clean the debris from the fish neck prior to the second run of attempting to remove the crown plug.

A bailer may be a well tool used to remove sand and other small pieces of debris from inside a tubing or casing of the well. For example, a bailer may be used to clean debris out of a fish neck prior to gripping the fish neck. Some conventional bailer tools may be pump-type tools that have a piston in cylinder and a check valve at the mouth of the cylinder. The bailer may be carried into the well on a wire (e.g., slickline). The piston may be lifted in the cylinder via the wire and debris entrained in liquid into the cylinder through the check valve. The check valve may close and seal the debris inside the cylinder. The piston may be lifted and lowered, via the wire, multiple times until the debris has been removed or the cylinder is full. Then, the bailer may be retrieved to the surface on the wire. While bailer may be used to clear debris from the fish neck, running multiple tools and tool assemblies downhole may be lengthy in time and costly in expenses. Typically, the longer an operation takes, the larger the opportunity cost in potential production value.

BRIEF DESCRIPTION OF THE DRAWINGS

These drawings illustrate certain aspects of some examples of the present disclosure, and should not be used to limit or define the disclosure.

DETAILED DESCRIPTION

This disclosure relates generally to pulling tools and, more particularly, to incorporating a bailer feature in pulling tools. By incorporation of the bailer feature into the pulling tools, the need for a separate trip to clear the fish neck of the crown plug of debris may be eliminated, thus reducing the number of trips downhole. While the examples of the present disclosure will be specifically described below for use in pulling crown plugs from subsea wells, it should be understood that the present techniques may be adapted for pulling plugs in any suitable well, whether on shore or off-shore. In addition, while the examples of the present disclosure are described for pulling crown plugs at the wellhead, the present techniques may be adapted for pulling any of a variety of well tools where clearing of debris may be needed, including, but not limited to, other plugs, flow control devices, packers, perforating guns, safety valves, pumps, gas lift valves, anchors, bridge plugs, and sliding sleeves. Moreover, by using one or more examples in accordance with the present disclosure, any combination of devices may be deployed or retrieved in accordance with the discussion below.

Figure 1:
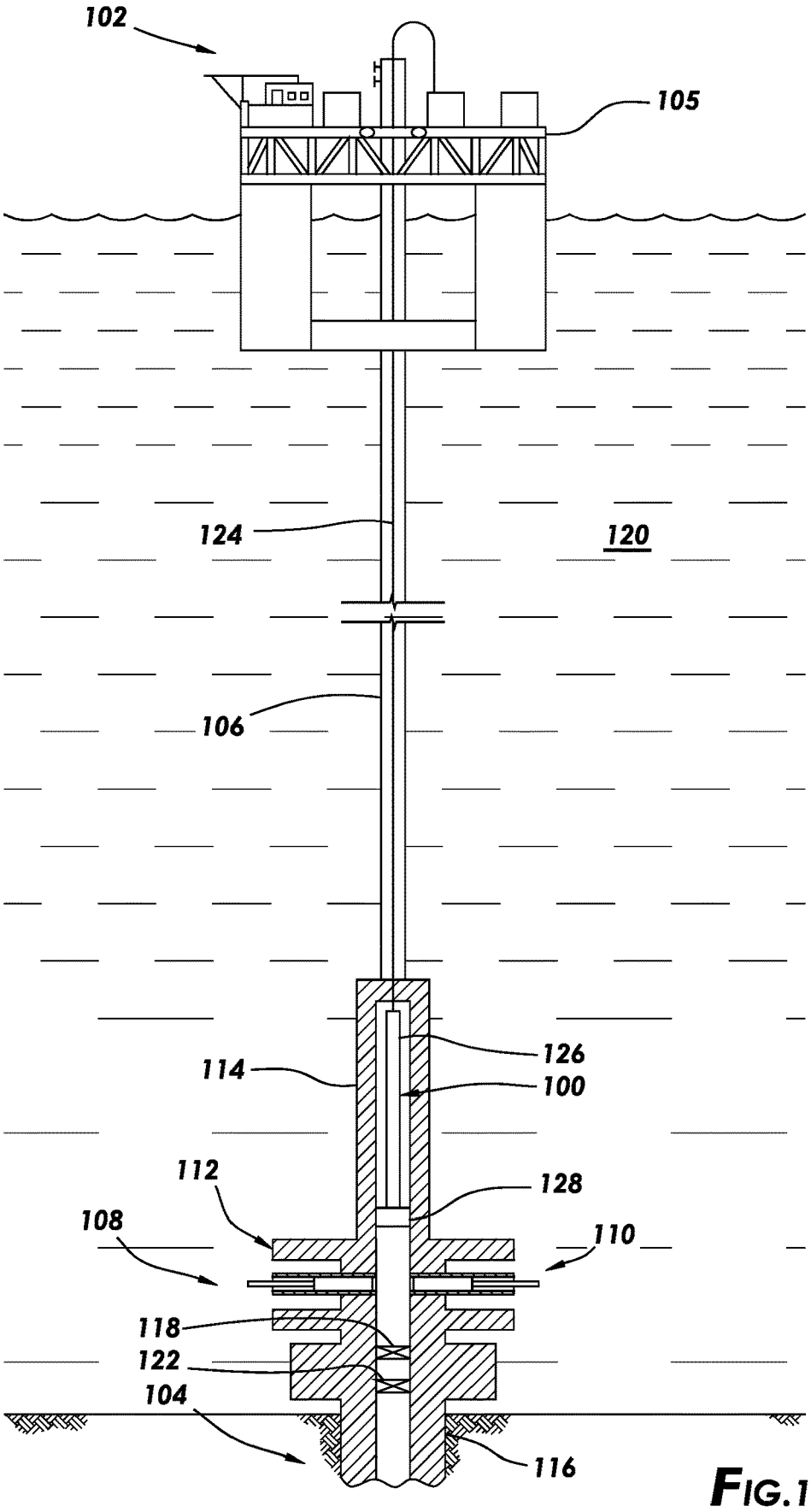
FIG. 1 is an example of an offshore oil and gas platform operating a pulling system.

Referring to FIG. 1, an example of a pulling system 100 is being operating from a platform 102. As illustrated, platform 102 may be positioned above a well 104, which may be a subsea oil and gas well, for example. While platform 102 is shown as a semi-submersible platform, it should be understood that pulling system 100 may be operating from other suitable platforms, including, but not limited to, fix platforms, drilling rigs, drillships, and floating production systems, among others. A conduit 106 may extend from deck 105 of platform 102 to wellhead assembly 108. Wellhead assembly 108 may include of a number of components conventionally used in subsea well completions, including but not limited to, Christmas tree 110 and one or more blow out preventers 112. A lubricator 114 or other suitable device may be positioned on wellhead assembly for allowing access to well 104 from platform 102. A wellbore 116 may extend from wellhead assembly 108.

Positioned within wellhead assembly 108 may be a first well tool 118, such as a crown plug used to seal well 104 from body of water 120. A second well tool 122, such as another crown plug, may also be positioned within wellhead assembly 108. First well tool 118 may be positioned above second well tool 122. In the illustrated embodiment, a fishing operation may be conducted that includes running pulling system 100 from platform 102 on a conveyance 124. Any suitable conveyance 124 may be used for supporting pulling system 100, including, but not limited to, wireline, slickline, electric line, coil tubing, or jointed tubing, among others. As illustrated, pulling system 100 may include an actuator unit 126 and a pulling tool 128.

In operation, plugging pulling system 100 may be run through conduit 106 to first well tool 118. The pulling tool 128 of the pulling system 100 may be landed on the first well tool 118. In some embodiments, pulling tool 128 may include a bailer feature designed clean debris from first well tool 118. For example, pulling tool 128 may be actuated to draw debris into pulling tool 128 from first well tool 118. Once the debris has been cleared, pulling tool 128 may be attached to first well tool 118. Pulling tool 128 may then be used to apply the required force to first well tool 118 to dislodge it from its position in wellhead assembly 108. For example, actuator unit 126 may apply sufficient force to first well tool 118 through pulling tool 128 to dislodge first well tool 118. With first well tool 118 dislodged, pulling system 100 and first well tool 118 may be retrieved to platform 102 from wellhead assembly 108.

Figure 2:
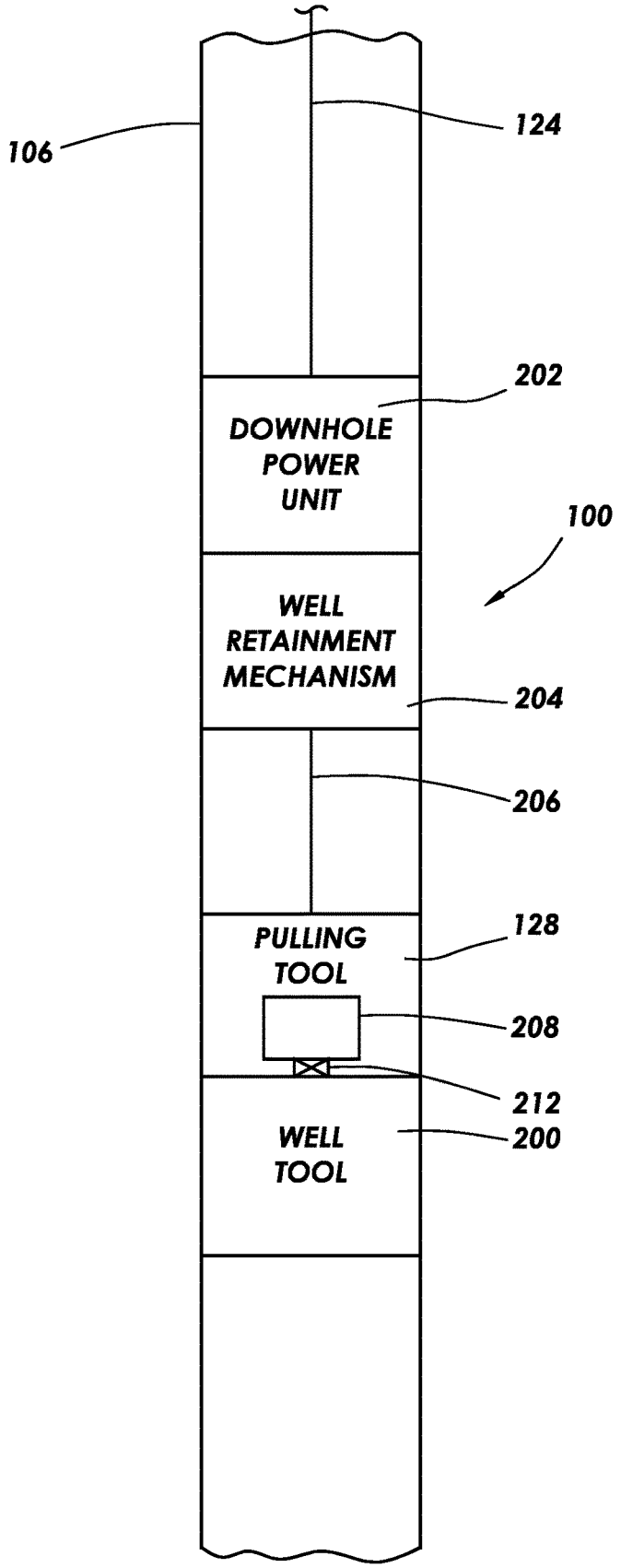
FIG. 2 is an example of a pulling system.

Referring now to FIG. 2, an example of pulling system 100 is shown. As illustrated, pulling system 100 may be run into conduit 106 on conveyance 124. Conduit 106 may include any suitable conduit, including but not limited to, subsea conductors, drill pipe, tubing, casing, other conduit in which pulling system 100 may be run for retrieval of well tool 200. In the illustrated embodiment, pulling system 100 has been run in conduit 106 to well tool 200. Well tool 200 may include any suitable device for removal from conduit 106, including, but not limited to, plugs (e.g., crown plugs), flow control devices, packers, perforating guns, safety valves, pumps, gas lift valves, anchors, bridge plugs, and sliding sleeves. Accordingly, well tool 200 may be any suitable device that has been previously positioned in conduit 106, whether at wellhead assembly 108 (e.g., FIG. 1) or in wellbore 116 (e.g., FIG. 1). The pulling tool 128 may be landed on first well tool 118. As illustrated, pulling system 100 may include downhole power unit 202, well retainment mechanism 204, and pulling tool 128. Downhole power unit 202 further may include a moveable shaft 206 that is operably associated with and extends through well retainment mechanism 204 and couples to pulling tool 128.

Either prior to, or after, pulling tool 128 has landed on well tool 200, pulling system 100 may be longitudinally secured in conduit 106 with well retainment mechanism 204. Any suitable well retainment mechanism 204 may be used, for example, that can retain pulling system 100 in conduit 106 to allow downhole power unit 202 to apply force to pulling tool 128, such as an anchor or landing shoulder. An anchor may be operated to engage inner surfaces of conduit 106, thereby longitudinally securing pulling system 100 within conduit 106. A landing shoulder engages an internal shoulder formed in the conduit 106, thereby longitudinally securing pulling system 100 within conduit 106. Once pulling system 100 is longitudinally secured and landed on well tool 200, pulling tool 128 may be operated to clear debris from well tool and used to dislodge well tool 200 in conduit 106. After well tool 200 has bene dislodged from conduit 106, the anchor can be released from conduit 106 so that pulling system 100 and well tool 200 may be retrieved from conduit 106.

The pulling tool 128 may be used to clear debris from well tool 200. For example, the pulling tool 128 may be used to clear debris from well tool 200, once pulling tool 128 has landed on well tool 200 and pulling system 100 has been longitudinally secured in conduit 106. As illustrated, pulling tool 128 may include a bailer chamber 208. A valve 212 may be positioned in pulling tool 128 to regulate flow into and out of bailer chamber 208. Any suitable valve type may be used for valve 212, including, but not limited to, a ball valve or a check valve with a flapper. In some embodiments, valve 212 may be battery-powered for remote operation through appropriate signals, such as hydraulic, electric, pressure, or mechanical signals. In alternative embodiments, the valve 212 may open when set on debris in well tool 200 but cannot enter the fish neck. After landing on well tool 200, pulling tool 128 may be actuated to activate its bailer functionality for clearing debris from well tool 200. By way of example, actuation of bailer functionality may include opening valve 212. Bailer chamber 208 may be underbalanced with respect to pressure in conduit so that suction is created upon opening valve 212 to draw debris from well tool 200 into bailer chamber 208. The underbalanced condition may be generated, for example, by maintaining bailer chamber 208 at or near atmospheric pressure. In some embodiments, bailer chamber 208 may be maintained at a pressure of up to about 210 kPa. Alternatively, the underbalanced condition may be generated through use of a piston (not shown) or other suitable mechanism. For example, the piston may be positioned in the bailer chamber 208 and drawn upwards to generate suction, drawing debris into bailer chamber 208. After clearing debris from well tool 200, pulling tool 128 may be attached to well tool 200.

The downhole power unit 202 may be used to apply force to well tool 200 with pulling tool 128 to dislodge well tool 200 from conduit 106. While not illustrated, downhole power unit 202 may include an elongated housing and a motor positioned in the elongated housing. The motor may be used to drive moveable shaft 206. For example, rotational energy generated by the motor may cause the moveable shaft 206 and, in turn, pulling tool 128 to both move longitudinally. Accordingly, when pulling system 100 is longitudinally fixed in conduit 106 a longitudinal force may be applied to well tool 200 through moveable shaft 206 and pulling tool 128. Alternatively, or additionally, torque may be transmitted from motor to moveable shaft 206 and, in turn, pulling tool 128. In this manner, downhole power unit 202 may operate as actuator unit 126 of FIG. 1 for applying force to pulling tool 128 for dislodging well tool 200. After well tool 200 is dislodged, well tool 200 and pulling system 100 may be retrieved. While downhole power unit 202 is shown on FIG. 2, it should be understood that other suitable devices may be used for actuator unit 126 of FIG. 1 that can apply force to pulling tool 128 for dislodging well tool 200, including, but not limited to, mechanical jars and hydraulic jars, among others.

Figure 3:
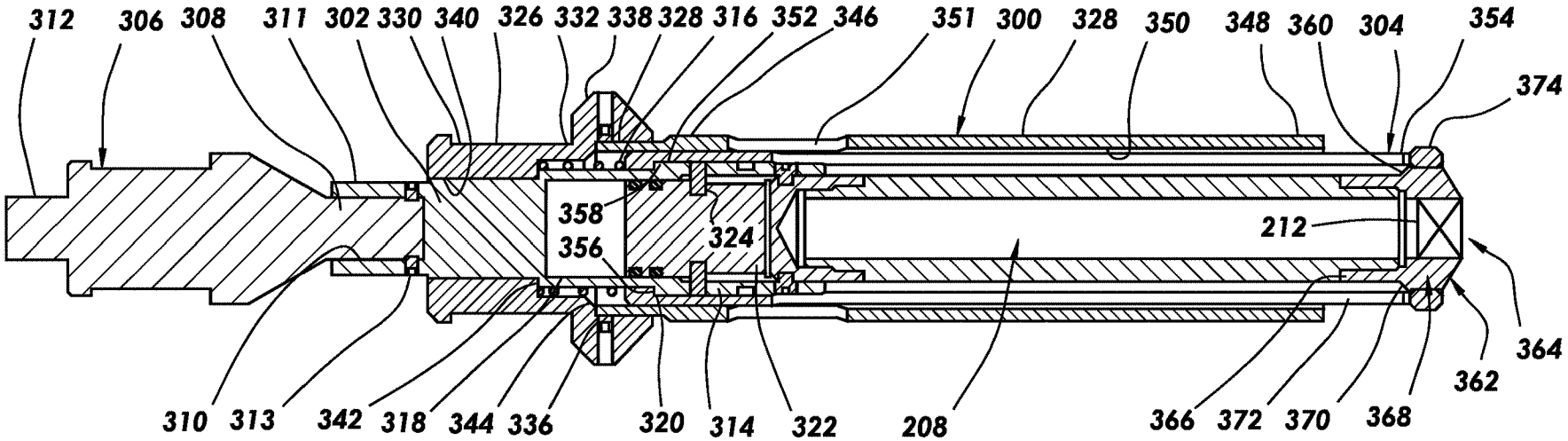
FIG. 3 is an example of a pulling tool.

Referring now to FIG. 3, an example of pulling tool 128 is shown. As illustrated, pulling tool 128 may include a housing 300, an inner mandrel 302, and a tool engagement assembly 304. Bailer chamber 208 may be positioned in tool engagement assembly 304. An upper portion of pulling tool 128 may include a top sub assembly 306, which may facilitate coupling of pulling tool 128 to a tool string. It should be understood the embodiment of pulling tool 128 is merely exemplary and the present disclosure is intended to encompass incorporation of bailer chamber 208 into other configurations of pulling tools.

Top sub assembly 306 may be coupled to inner mandrel 302. As illustrated, distal end 308 of top sub assembly 306 may be secured in a socket 310 at proximal end 311 of inner mandrel 302. Any suitable technique may be used for coupling of top sub assembly 306 to inner mandrel 302, including but not limited to, threading and/or mechanical fasteners, among others. As illustrated, one or more set screws 313 may be applied through proximal end 311 of inner mandrel 302 and into top sub assembly 306 to secure them to one another. Top sub assembly 306 may be elongated and may be used to facilitate coupling of pulling tool 128 to a tool string. For example, proximal end 312 of top sub assembly 306 may be secured to a tool string.

Inner mandrel 302 may include a proximal end 311 and a distal end 314. While proximal end 311 is shown coupled to top sub assembly 306, in some embodiments, proximal end 311 may be coupled to moveable shaft 206 of downhole power unit 202 (e.g., shown on FIG. 2) or other suitable tool. Spring 316 may be positioned around a central portion 318 of inner mandrel 302. Distal end 314 of inner mandrel 302 may have an increased diameter with respect to central portion 318 forming shoulder 320. At distal end 314, a central piston 322 may be at least partially secured to central piston 322. As illustrated, central piston 322 extends at least partially into inner mandrel 302. One or more shear pins 324 may secure central piston 322 to inner mandrel 302. At a desired time, fluid pressure can be applied through pulling tool 128 to drive piston into inner mandrel 302 cause shear pins 324 to break. As will be discussed in more detail below, the central piston 322 may be used to overcome biasing pressure applied to tool engagement assembly 304 when desired to release tool engagement assembly 304 from coupling with well tool (e.g., first well tool 118 on FIG. 1 or crown plug 400 on FIG. 4).

Housing assembly 300 may include one or more housing members. Suitable housing members may include, for example, axially elongated members that may be tubular in shape with a longitudinal through bore. As illustrated, housing 300 may include upper housing 326 and lower housing 328. Upper housing 326 may include proximal end 330 and distal end 332. Distal end 332 of upper housing 326 may be secured to proximal end 346 of lower housing 328. Any suitable technique may be used for coupling of upper housing 326 to lower housing 328, including but not limited to, threading and/or mechanical fasteners, among others. As illustrated, one or more shear screws 336 may be applied through upper housing 326 and into lower housing 328, for example, to compensate for hydrostatic pressure. While upper housing 326 and lower housing 328 are illustrated as separate components, upper housing 326 and lower housing 328 may alternatively be a single, unitary member forming housing 300. Upper housing 326 may include a through bore 340 extending longitudinally there through. Inner mandrel 302 may be at least partially positioned in upper housing 326. Any suitable technique may be used for coupling of inner mandrel 302 to upper housing, including but not limited to, threading and/or mechanical fasteners, among others. A first internal shoulder 342 may be formed in through bore 340. Spring 316 may engage first internal shoulder 342. A second internal shoulder 344 may be formed in through bore 340. Lower housing 328 may land on second internal shoulder 344 when inserted into through bore 340 of upper housing 326.

Lower housing 328 may have a proximal end 346 and a distal end 348 with a through bore 350 that extends longitudinally from proximal end 346 to distal end 348. As illustrated, proximal end 346 may be inserted into upper housing 326, landing on second internal shoulder 344. Lower housing 328 may be axially elongated and generally tubular in form. One or more windows 351 may be formed in lower housing 328. Windows 351 may function, for example, to facilitate disengagement of tool engagement assembly 304 from well tool at surface. By way of example, windows 351 may allow access to tool engagement assembly 304 through lower housing 328 so that tool engagement assembly 304 may be manually manipulated to release well tool after recovery at surface. In some embodiments, hydrostatic pressure alone may also be used for release of tool engagement assembly 304 from well tool.

Housing 300 may further include a centralizer portion 338. Centralizer portion 338 may engage inner surfaces of conduit 106 (e.g., FIG. 1) while pulling tool 128 is run, for example, to assist maintenance of pulling tool 128 in center of conduit 106. Centralizer portion 338 may project radially from upper housing 326. While lower housing 328 is shown on upper housing 326, centralizer portion 338 may be otherwise positioned, for example, on lower housing 328. In the illustrated embodiment, lower housing 328 is shown as being integrally formed with upper housing 326; however, it is contemplated that lower housing 328 may a separate device that can be attached to housing 300.

Tool engagement assembly 304 may include a proximal end 352 and a distal end 354. As illustrated, tool engagement assembly 304 may be axially elongated and at least partially extend into housing 300. For example, tool engagement assembly 304 may extend into through bore 350 of lower housing 328. Proximal end 352 of tool engagement assembly 304 may receive at least a portion of central piston 322. The proximal end 352 of tool engagement assembly 304 may include an inner shoulder 356 that is complimentary to an outer shoulder 358 of central piston 322. Inner shoulder 356 of tool engagement assembly 304 may engage outer shoulder 358 of central piston 322 to retain tool engagement assembly 304 in housing 300. Spring 316 may provide a biasing force to tool engagement assembly 304. As illustrated, spring 316 may be positioned around central piston between first internal shoulder 342 of upper housing 326 and inner shoulder 356 at distal end 354 of tool engagement assembly 304.

Figure 4:
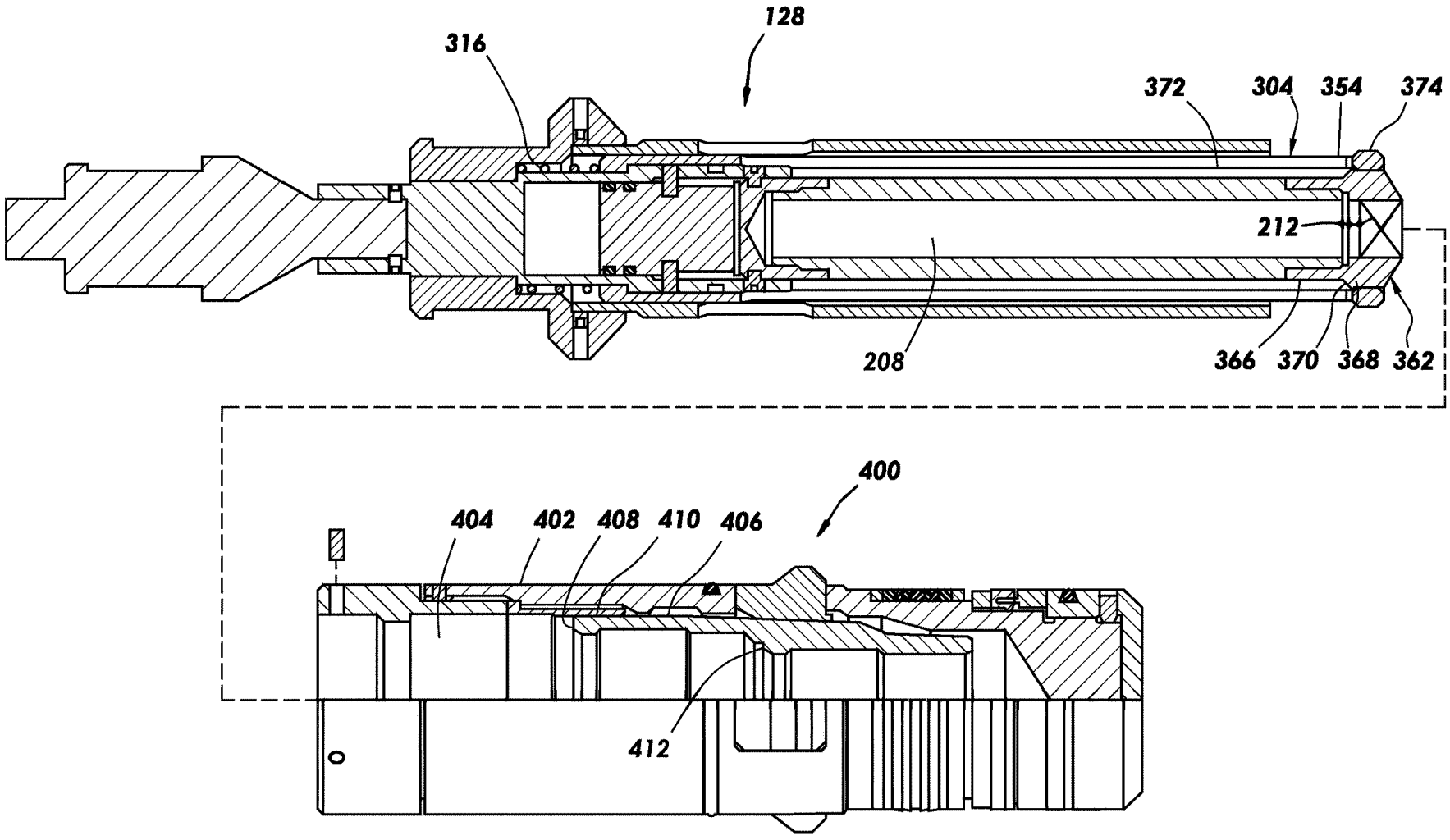
FIG. 4 is an example illustrating insertion of the pulling tool into a crown plug.

Distal end 354 of tool engagement assembly 304 may also be referred to a latching end as distal end 354 facilitates coupling of tool engagement assembly 304 to well tool (e.g., first well tool 118 on FIG. 1, well tool 200 on FIG. 2, or crown plug XX on FIG. 4). Distal end 354 may be referred to as a latching end as distal end 354 may be configured for attachment to well tool. As illustrated, distal end 354 of tool engagement assembly 304 extends from distal end 348 of lower housing 328 and includes an opening 364 for fluid flow into bailer chamber 208 formed in tool engagement assembly 304. Tool engagement assembly 304 may include a latching mandrel 360. While not shown, latching mandrel 360 may be coupled to central piston 322 by any suitable connection, such as threaded connection or mechanical fasteners. Latching mandrel 360 may include a beveled fishing nose 362. Opening 364 may be formed at distal end 354 of tool engagement assembly 304. As illustrated, opening 364 may be formed in beveled fishing nose 362. Latching mandrel 360 may further include a reduced diameter portion 366 coupled to an increased diameter portion 368 connected by ramped surface 370. The increased diameter portion 368 may be positioned adjacent to beveled fishing nose 362. Tool engagement assembly 304 may also include a plurality of latching members 372 spaced around an outer surface of latching mandrel 360. The latching members 372 may be slidably positioned on latching mandrel 360 and may extend in a direction parallel to an axis of pulling tool 128. Inner shoulder 356 at distal end 354 of tool engagement assembly 304 may be formed on latching members 372. Each of latching members 372 may have an enlarged end portion 374 at distal end 354. As illustrated, the enlarged end portions 374 may project radially outward. Spring 316 may be positioned between latching members 372 and upper housing 326 to bias latching members 372. For example, spring 316 may urge latching members 372 forward towards beveled fishing nose 362 of tool engagement assembly 304.

Bailer chamber 208 may be formed in tool engagement assembly 304. When running pulling tool 128 into conduit 106, bailer chamber 208 may be sealed from the exterior of pulling tool 128. Bailer chamber 208 may be underbalanced with respect to exterior pressure during operation. The underbalanced condition may be generated, for example, by maintaining bailer chamber 208 at or near atmospheric pressure. In some embodiments, bailer chamber 208 may be maintained at a pressure of up to about 210 kPa. Alternatively, the underbalanced condition may be generated through use of a piston (not shown) or other suitable mechanism. For example, the piston may be positioned in the bailer chamber 208 and drawn upwards to generate suction during use. Opening 364 in tool engagement assembly 304 may provide for fluid communication between bailer chamber 208 and the exterior of the pulling tool 128. Valve 212 may be positioned in opening 364 to regulate flow through opening 364 and, thus, regulate flow into and out of bailer chamber 208.

Referring now to FIG. 4, an example of pulling tool 128 is shown disengaged from crown plug 400. As previously described, pulling tool 128 may be used in dislodging a well tool, such as crown plug 400. As illustrated, crown plug 400 may include a plug body 402 having a through bore 404 that extends longitudinally through plug body 402. Plug body 402 may be axially elongated. Crown plug 400 may include a fishneck 406 positioned in through bore 404. Fishneck 406 may be a sleeve that is positioned in through bore 404. Alternatively, fishneck 406 may be integrally formed with plug body 402. Fishneck 406 may include one or more internal ramp portions, shown as first ramp portions 410 and second ramp portions 412. First ramp portions 410 may be positioned on enlarged proximal end 408 of fishneck 406.

In operation, pulling tool 128 may be run to crown plug 400. Distal end 354 of tool engagement assembly 302 may be inserted into through bore 404 of plug body 402 and landed on fishneck 406. As previously described, debris may be accumulated in fishneck 406 that should be cleared to facilitate latching to, and dislodging of, crown plug 400. After placement of the tool engagement assembly 302 into plug body 402, valve 212 may be opened so that bailer chamber 208 may be in fluid communication with through bore 404 of plug body 402. Because bailer chamber 208 may be underbalanced, a suction may be created upon opening valve 212 to draw debris from through bore 404 of crown plug 400 and into bailer chamber 208. The bailer chamber 208 may be sized, for example, to hold a required volume of debris. After suctioning debris, the tool engagement assembly 302 may be coupled to crown plug 400, for example, distal end 354 of tool engagement assembly 302 may be coupled to crown plug 400. For coupling, the distal end 354 may be advanced into fishneck 406. As distal end 354 moves into fishneck 406, beveled nose 362 may first engage first ramp portions 410 of fishneck 406. Enlarged end portions 374 of latching members 372 may also engage enlarged proximal end 408 of fishneck 406 such that latching members 372 may be pushed against spring 316. The spring 316 may be compressed, allowing latching members 372 to be moved away from beveled nose 362, whereby enlarged end portions 374 may be moved down ramped surfaces 370 from increased diameter portion 368 to reduced diameter portion 366. This allows enlarged end portions 374 to move past enlarged proximal end 408 of fishneck 406 to within fishneck 406. Once the enlarged end portions 374 of latching members 372 pass the first ramp portions 410, the spring 316 moves the latching members 372 and enlarged end portions 374 in the opposite direction such that the enlarged end portions 374 rest on the increased diameter portion 368. In some embodiments, the latching members 372 may be further advanced into fishneck 406, for example, to engage second ramp portions 412 of fishneck 406. The pulling tool 128 may then be pulled upward with the enlarged end portions 374 of the latching members 372 engaging the enlarged proximal end 410 to couple the pulling tool 128 to crown plug 400.

Figure 5:
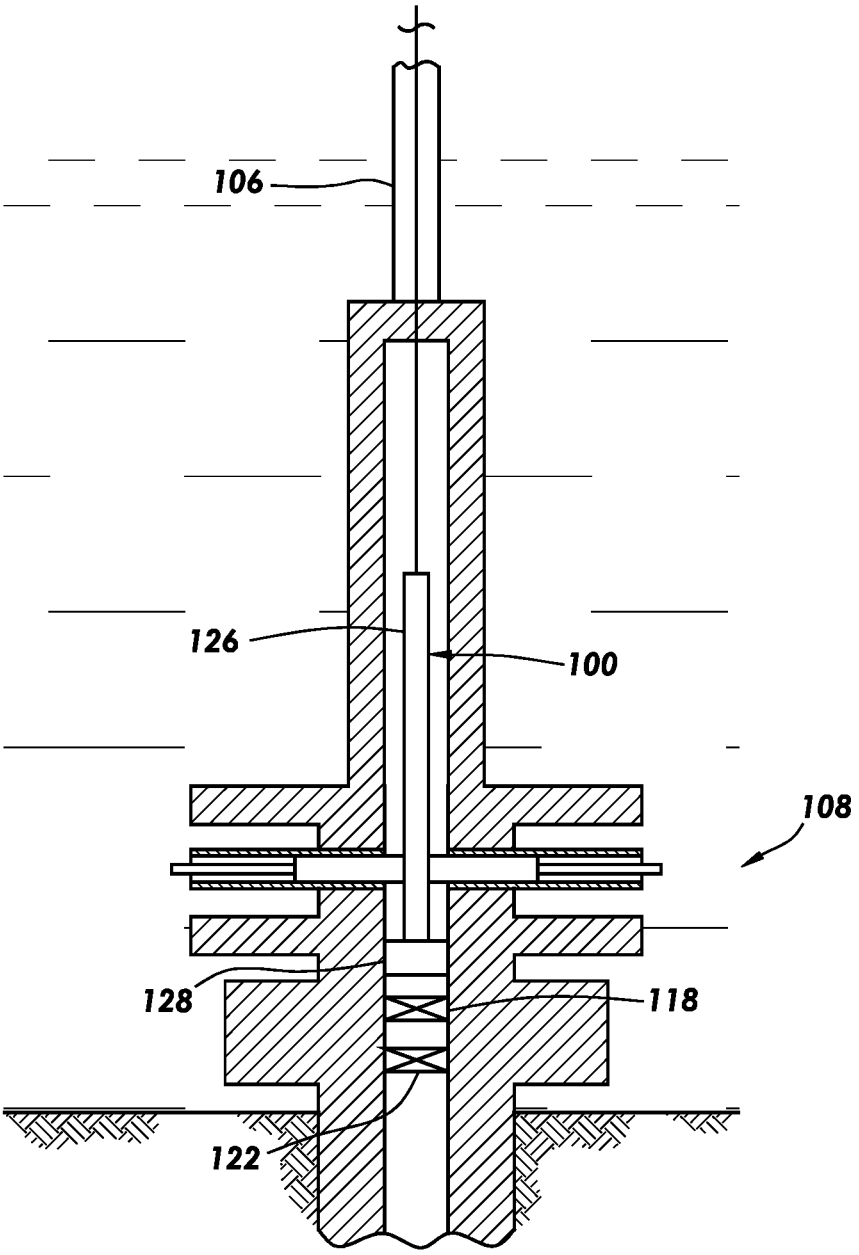
FIGS. 5 to 7 illustrate an example method for pulling a crown plug.
Figure 6:
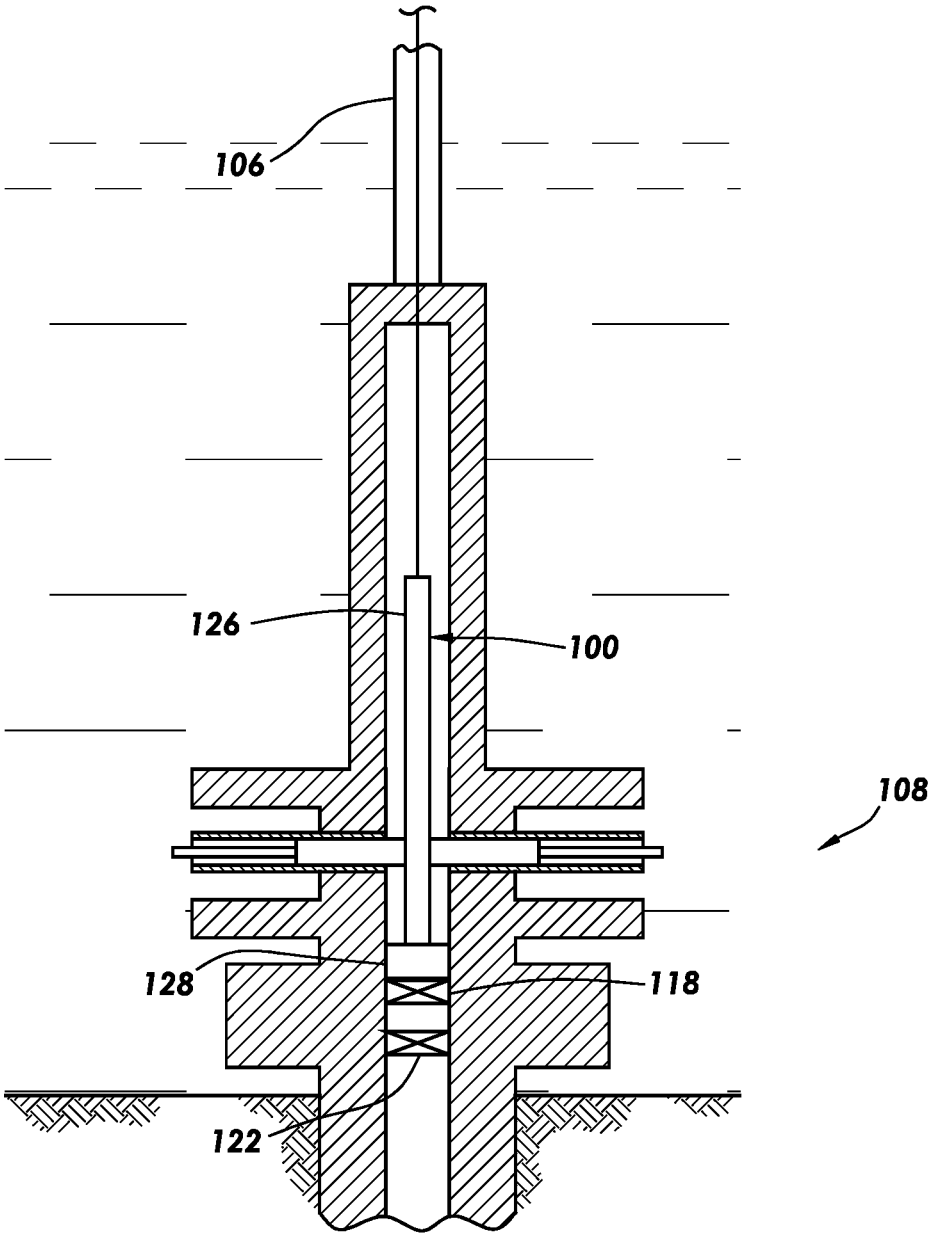
Figure 7:
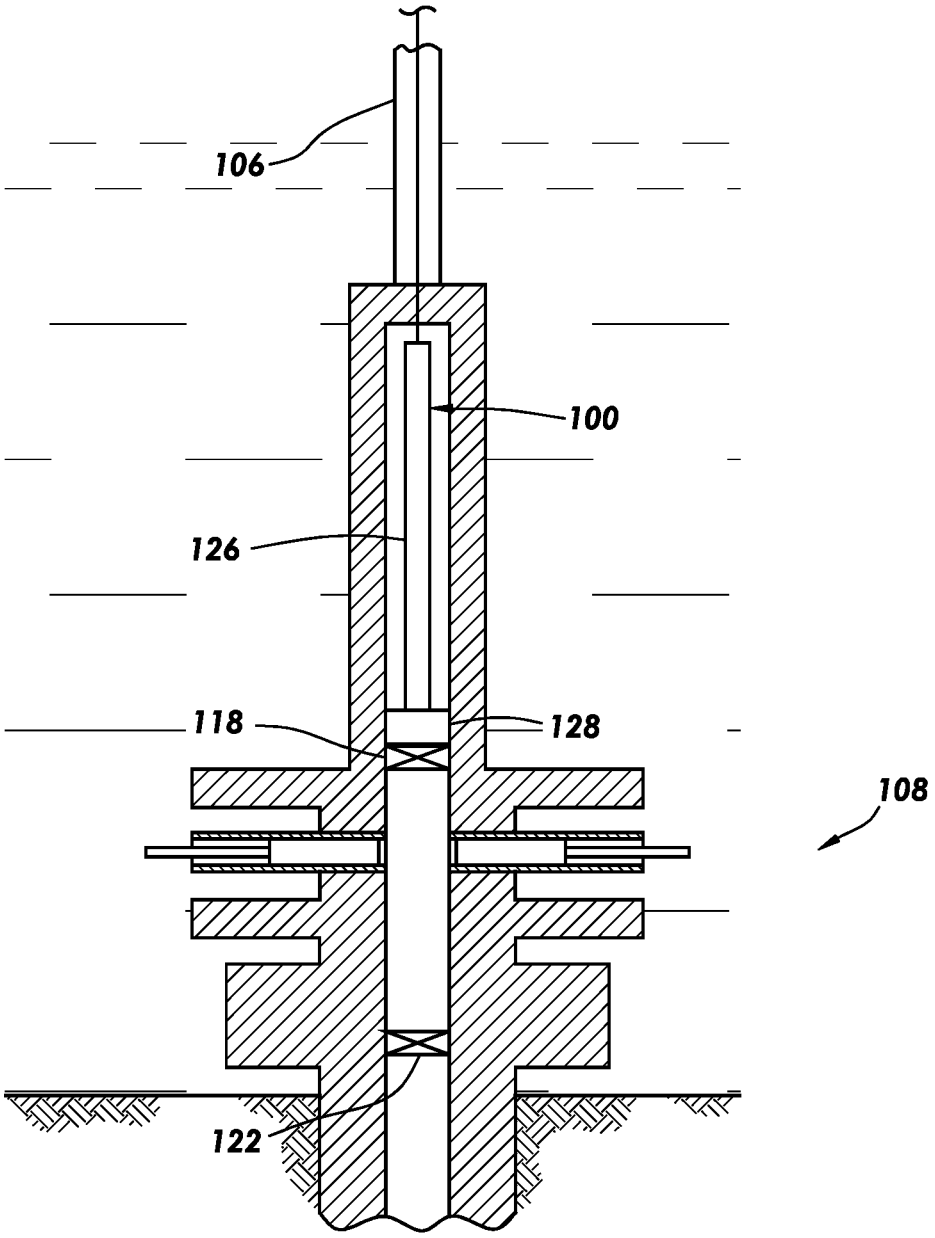

Referring now to FIGS. 5-7, an example method for pulling a first well tool 118 (e.g., crown plug 400 on FIG. 4) is shown. FIG. 5 illustrates running of pulling system 100 through conduit 106 to wellhead assembly 108. As illustrated, pulling system 100 may include actuator unit 126 and pulling tool 128. First well tool 118 and second well tool 122 may be positioned in wellhead assembly 108. FIG. 6 illustrates pulling system 100 landed on first well tool 118. As illustrated, pulling tool 128 may be in engagement with first well tool 1118. As previously described, pulling tool 128 may include a bailer feature (e.g., bailer chamber 208 on FIG. 3) for clearing debris from first well tool 118. Pulling tool may be actuated (e.g., opening valve 212 on FIG. 3) to draw the debris into pulling tool 128. Once the debris has been cleared, pulling tool 128 may be attached to first well tool 118. Pulling tool 128 may then be used to apply the required force to first well tool 118 to dislodge it from its position in wellhead assembly 108. For example, actuator unit 126 may apply sufficient force (e.g., rotational and/or longitudinal) to first well tool 118 through pulling tool 128 to dislodge first well tool 118. With first well tool 118 dislodged, pulling system 100 and first well tool 118 may be retrieved from wellhead assembly 108, as shown on FIG. 7.

Accordingly, the preceding description provides a pulling tool that incorporates a bailer feature. The apparatus, systems, and methods that incorporate the bailing feature may include any of the various features of the apparatus, systems, and methods disclosed herein, including one or more of the following statements.

Statement 1: A pulling tool may be provided that includes a housing. The pulling tool may further include a tool engagement assembly securing in the housing with a distal end of the tool engagement assembly extending from the housing for engagement with a well tool. The pulling tool may further include a bailer chamber formed in the tool engagement assembly and in fluid communication with an exterior of the pulling tool through an opening in the distal end of the tool engagement assembly. The pulling tool may further include a valve positioned in the opening of the tool engagement assembly.

Statement 2. The pulling tool of statement 1, wherein the housing includes: a lower housing; an upper housing coupled to the lower housing; and a centralizer portion that radially extends from the upper housing.

Statement 3. The pulling tool of statement 1 or 2, wherein the tool engagement assembly includes a beveled fishing nose that includes the opening in the distal end of tool engagement assembly.

Statement 4. The pulling tool of statement 3, wherein the tool engagement assembly includes: a latching mandrel extending into the housing and including the beveled fishing nose; and a plurality of latching members slidably positioned on the latching mandrel around an outer surface of the latching mandrel.

Statement 5. The pulling tool of statement 4, wherein the latching mandrel further includes: a reduced diameter portion; an increased diameter portion adjacent to the beveled fishing nose; and a ramped surface connecting the reduced diameter portion and the increased diameter portion, and wherein the latching members are spring biased toward the beveled fishing nose and each includes an enlarged end portion on the increased diameter portion of the latching mandrel.

Statement 6. The pulling tool of any preceding statement, wherein the bailer chamber is sealed from an exterior of the pulling tool when the valve is closed.

Statement 7. The pulling tool of any preceding statement, wherein the bailer chamber is at a pressure of up to about 210 kPa to generate a suction when an exterior pressure of the pulling tool is greater than the pressure of the bailer chamber and the valve is open.

Statement 8. The pulling tool of any preceding statement, further including: a central mandrel in the housing at a proximal end of the housing; a spring positioned around a central portion of the central mandrel; and a central piston secured to a distal end of the central mandrel and a proximal end of the tool engagement assembly.

Statement 9. The pulling tool of any preceding statement, further including a top sub assembly at a proximal end of the housing and coupled to a central mandrel in the housing.

Statement 10. The pulling tool of any preceding statement, wherein the tool engagement assembly attaches to a fishneck of a crown plug.

Statement 11. A pulling system may be provided that includes a pulling tool. The pulling tool may include a proximal end, a distal end, a housing, and a tool engagement assembly secured in the housing with a distal end extending from the housing for attachment to a well tool. The pulling tool may further include a bailer chamber formed in the tool engagement assembly and in fluid communication with an exterior of the pulling tool through an opening in the distal end of the tool engagement assembly. The pulling tool may further include a valve positioned in the opening of the tool engagement assembly. The pulling system may further include an actuator unit coupled to the distal end of the pulling tool and configured to transmit force to the well tool through the pulling tool.

Statement 12. The pulling system of statement 11, wherein the bailer chamber is sealed from an exterior of the pulling tool when the valve is closed.

Statement 13. The pulling system of statement 11 or 12, wherein the bailer chamber is at a pressure of up to about 210 kPa to generate a suction when an exterior pressure of the pulling system is greater than the pressure of the bailer chamber and the valve is open.

Statement 14. The pulling system of any one of statements 11 to 13, wherein the actuator unit further includes a downhole power unit and a moveable shaft coupled to the pulling tool for transmitting force from the downhole power unit to the pulling tool.

Statement 15. The pulling system of any one of statements 11 to 14, further including a well retainment mechanism between the actuator unit and the pulling system.

Statement 16. A method for pulling a well tool from a well may be provided. The method may include providing a pulling tool including: a housing; a tool engagement assembly secured in the housing with a distal end extending from the housing; a bailer chamber formed in the tool engagement assembly and in fluid communication with an exterior of the pulling tool through an opening in the distal end of the tool engagement assembly; and a valve positioned in the opening of the tool engagement assembly. The method may further include running the pulling tool through a conduit to the well tool. The method may further include opening the valve such that a suction is created upon the opening the valve to draw debris from an interior portion of the well tool into the bailer chamber. The method may further include attaching the distal end of the tool engagement tool to the well tool. The method may further include applying force to the well tool with the pulling tool to dislodge the well tool in the well. The method may further include retrieving the well tool and the pulling tool from the well.

Statement 17. The method of statement 16, wherein the opening the valve includes applying a jarring force through a tool string to the pulling tool.

Statement 18. The method of statement 16 or 17, further including landing the pulling tool on the well tool such that the distal end of the tool engagement assembly extends into an interior portion of the well tool.

Statement 19. The method of statement 18, wherein the landing the pulling tool on the well tool causes the valve to open.

Statement 20. The method of any one of statements 16 to 19, wherein the well tool includes a crown plug that is positioned in a wellhead assembly.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A pulling tool comprising:

a housing;

a tool engagement assembly secured in the housing with a distal end extending from the housing for engagement with a well tool;

a bailer chamber formed in the tool engagement assembly and in fluid communication with an exterior of the pulling tool through an opening in the distal end of the tool engagement assembly; and a valve positioned in the opening of the tool engagement assembly, the valve operable to draw debris into the bailer chamber from the well tool.

2. The pulling tool of claim 1, wherein the housing includes: a lower housing; an upper housing coupled to the lower housing; and a centralizer portion that radially extends from the upper housing.

3. The pulling tool of claim 1, wherein the tool engagement assembly includes a beveled fishing nose that includes the opening in the distal end of tool engagement assembly.

4. The pulling tool of claim 3, wherein the tool engagement assembly includes: a latching mandrel extending into the housing and including the beveled fishing nose; and a plurality of latching members slidably positioned on the latching mandrel around an outer surface of the latching mandrel.

5. The pulling tool of claim 4, wherein the latching mandrel further includes: a reduced diameter portion; an increased diameter portion adjacent to the beveled fishing nose; a ramped surface connecting the reduced diameter portion and the increased diameter portion, and wherein the latching members are spring biased toward the beveled fishing nose and each includes an enlarged end portion on the increased diameter portion of the latching mandrel.

6. The pulling tool of claim 1, wherein the bailer chamber is sealed from an exterior of the pulling tool when the valve is closed.

7. The pulling tool of claim 1, wherein the bailer chamber is at a pressure of up to about 210 kPa to generate a suction when an exterior pressure of the pulling tool is greater than the pressure of the bailer chamber and the valve is open.

8. The pulling tool of claim 1, further including: a central mandrel in the housing at a proximal end of the housing; a spring positioned around a central portion of the central mandrel; and a central piston secured to a distal end of the central mandrel and a proximal end of the tool engagement assembly.

9. The pulling tool of claim 1, further including a top sub assembly at a proximal end of the housing and coupled to a central mandrel in the housing.

10. The pulling tool of claim 1, wherein the distal end of the tool engagement assembly attaches to a fishneck of a crown plug.

11. A pulling system comprising:

a pulling tool including: a proximal end; a distal end; a housing; a tool engagement assembly secured in the housing with a distal end extending from the housing for engagement with a well tool; a bailer chamber formed in the tool engagement assembly and in fluid communication with an exterior of the pulling tool through an opening in the distal end of the tool engagement assembly; and a valve positioned in the opening of the tool engagement assembly, the valve operable to draw debris into the bailer chamber from the well tool; and an actuator unit coupled to the distal end of the pulling tool to transmit force to the well tool through the pulling tool.

12. The pulling system of claim 11, wherein the bailer chamber is sealed from an exterior of the pulling tool when the valve is closed.

13. The pulling system of claim 11, wherein the bailer chamber is at a pressure of up to about 210 kPa to generate a suction when an exterior pressure of the pulling system is greater than the pressure of the bailer chamber and the valve is open.

14. The pulling system of claim 11, wherein the actuator unit further includes a downhole power unit and a moveable shaft coupled to the pulling tool for transmitting force from the downhole power unit to the pulling tool.

15. The pulling system of claim 11, further including a well retainment mechanism between the actuator unit and the pulling system.

16. A method for pulling a well tool from a well, comprising:

providing a pulling tool including: a housing; a tool engagement assembly secured in the housing with a distal end extending from the housing; a bailer chamber formed in the tool engagement assembly and in fluid communication with an exterior of the pulling tool through an opening in the distal end of the tool engagement assembly; and a valve positioned in the opening of the tool engagement assembly;

running the pulling tool through a conduit to the well tool;

opening the valve such that a suction is created upon the opening the valve to draw debris from an interior portion of the well tool into the bailer chamber;

attaching the distal end of the tool engagement tool to the well tool;

applying force to the well tool with the pulling tool to dislodge the well tool in the well; and retrieving the well tool and the pulling tool from the well.

17. The method of claim 16, wherein the opening the valve includes applying a jarring force through a tool string to the pulling tool.

18. The method of claim 16, further including landing the pulling tool on the well tool such that the distal end of the tool engagement assembly extends into an interior portion of the well tool.

19. The method of claim 18, wherein the landing the pulling tool on the well tool causes the valve to open.

20. The method of claim 16, wherein the well tool includes a crown plug that is positioned in a wellhead assembly.

* * * * *